US005915375A

United States Patent [19]

Reyher

[11] Patent Number: 5,915,375

[45] Date of Patent: Jun. 29, 1999

[54] FIREPLACE WITH DIRECT VENT AND SLOPED TOP WALL

[75] Inventor: Russell E. Reyher, Winnipeg, Canada

[73] Assignee: R-Co Inc., Winnipeg, Canada

[21] Appl. No.: 08/856,504

[22] Filed: May 15, 1997

[51] Int. Cl.[6] ..... B22D 27/02

[52] U.S. Cl. ..... 126/512; 126/521; 126/528

[58] Field of Search ..... 126/85 B, 512, 126/521, 523, 527, 528

[56] References Cited

U.S. PATENT DOCUMENTS 5,452,708 9/1995 Shimek et al. .

*Primary Examiner*—Ira S. Lazarus
*Assistant Examiner*—David Lee
*Attorney, Agent, or Firm*—Murray E. Thrift; Adrian D. Battison

[57] ABSTRACT

A direct vent gas fireplace has a combustion air duct extending down the back wall, between the housing back wall and the fireplace back wall. It is located laterally between two cooling air ducts that lead from the cool air zones at the bottom outer corners of the housing to a cooling air plenum inside the top of the housing. Inside the cooling air plenum and the cooling air ducts are a room air plenum and room air circulating space for the circulation of room air to be heated. This provides a compact construction with adequate wall cooling without the need for additional thermal insulation. The top of the unit is oriented at an angle less than 45°, preferably 23.2° to horizontal so that the exhaust and vent pipes can be arranged in a top vent or a back vent arrangement without the pipes projecting beyond the back of the fireplace unit in the top vent arrangement.

8 Claims, 2 Drawing Sheets

FIREPLACE WITH DIRECT VENT AND SLOPED TOP WALL

FIELD OF THE INVENTION

The present invention relates to fireplaces and more particularly to direct vent gas fireplaces.

BACKGROUND

With direct vent gas fireplaces, it is preferred to minimize the clearance required between the unit and combustible materials. The ideal is "zero clearance". To achieve this, fireplaces have been constructed with wrappings of thermal insulation and plural circulation chambers around the firebox. The air chambers heat room air as well as providing insulation. This increases the overall size of the fireplace, making the unit project some distance into a room when installed in a standard stud wall.

Conventional direct vent gas fireplace design has been either a top vent or back vent configuration. Recently, units with sloped top walls oriented at 45° to horizontal have been proposed so that a 45° elbow can be used to produce either a top vent or a back vent arrangement using the same unit. With the top vent arrangement, it is found that the position of the vertical run of the combustion air duct limits the depth to which the unit may be installed in a wall. This is not a significant problem with conventional fireplace designs. If however, the depth of the unit is reduced, it becomes a limiting factor.

The present invention is concerned with certain improvements in direct vent gas fireplaces.

SUMMARY

According to one aspect of the present invention there is provided a fuel burning appliance comprising:

an outer sheet metal housing with:
- a bottom;
- a vertical outer back wall;
- a sloped outer top wall sloping upwardly from the outer back wall towards a front side of the housing;

an inner sheet metal fire box inside the outer housing and with:
- a vertical inner back wall spaced from the outer back wall of the housing, the inner vertical back wall having a combustion air inlet therethrough, adjacent a bottom end of the inner back wall;
- a sloped inner top wall sloping upwardly from the inner back wall toward a front side of the fire box and spaced from the outer top wall;
- an inner bottom wall spaced from the bottom of the housing;

a combustion air duct comprising a plenum on top of the outer top wall and a duct extending from the plenum between the outer and inner back walls to the combustion air inlet;

two cooling air ducts between the inner and outer back walls on opposite sides of the combustion air duct and having inlets between the bottom of the outer housing and the inner bottom wall, and adjacent the respective side walls;

a top cooling air duct leading from the tops of the back cooling air ducts and between the inner and outer top walls to a warm air discharge;

an exhaust gas outlet extending outwardly from an opening in the inner top wall through the plenum; and a fresh air inlet concentric with the exhaust gas outlet and communicating with the plenum.

The combustion air duct and the cooling air ducts are thus arranged side by side in the back wall, rather than having the combustion air duct on the outside of the outer back wall as is the normal practice. This significantly reduces the depth of the unit. It has been found that the combustion air duct may be placed in direct contact with the inner back wall of the firebox. The cooling air is drawn from the bottom outside corners of the unit, below the firebox. The air in this area is the coolest available for supply to the cooling air ducts. This arrangement allows a reduction in the back wall thickness, while maintaining adequately low temperature levels on the outer back wall, even without a layer of thermal insulation in or on the back wall.

In the preferred embodiments of the invention, the cooling air ducts are spaced from the back wall of the firebox so that a room air flow can be generated around the firebox, transferring heat from the firebox to the circulated room air.

According to another aspect of the present invention there is provided a direct vent gas fireplace with a top wall having therein a substantially cylindrical combustion air inlet and a substantially cylindrical exhaust gas outlet within the combustion air inlet, wherein the combustion air inlet and the exhaust gas outlet are inclined to the horizontal at an angle between 45° and 90°.

The preferred orientation of the intake and exhaust is about 66.8° to horizontal. They are preferably perpendicular to the top wall of the fireplace, which slopes upwards from back to front at an angle between 0° and 45°, preferably 23.2°. Flexible ducting can be used for the concentric combustion air inlet pipe and the exhaust pipe to accommodate the different bend angles for top and back vent installations.

BRIEF DESCRIPTION OF THE DRAWINGS

In the accompanying drawings, which illustrate an exemplary embodiment of the present invention.

DETAILED DESCRIPTION

Figure 1:
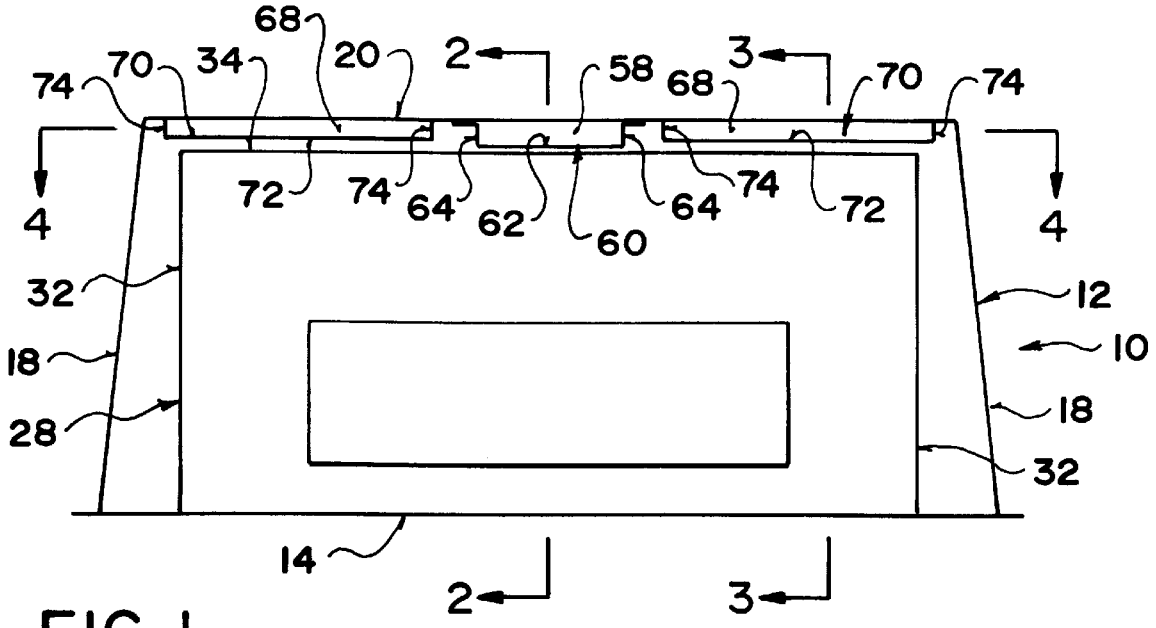
FIG. 1 is a plan view in cross-section of a fireplace unit according to the present invention.
Figure 4:
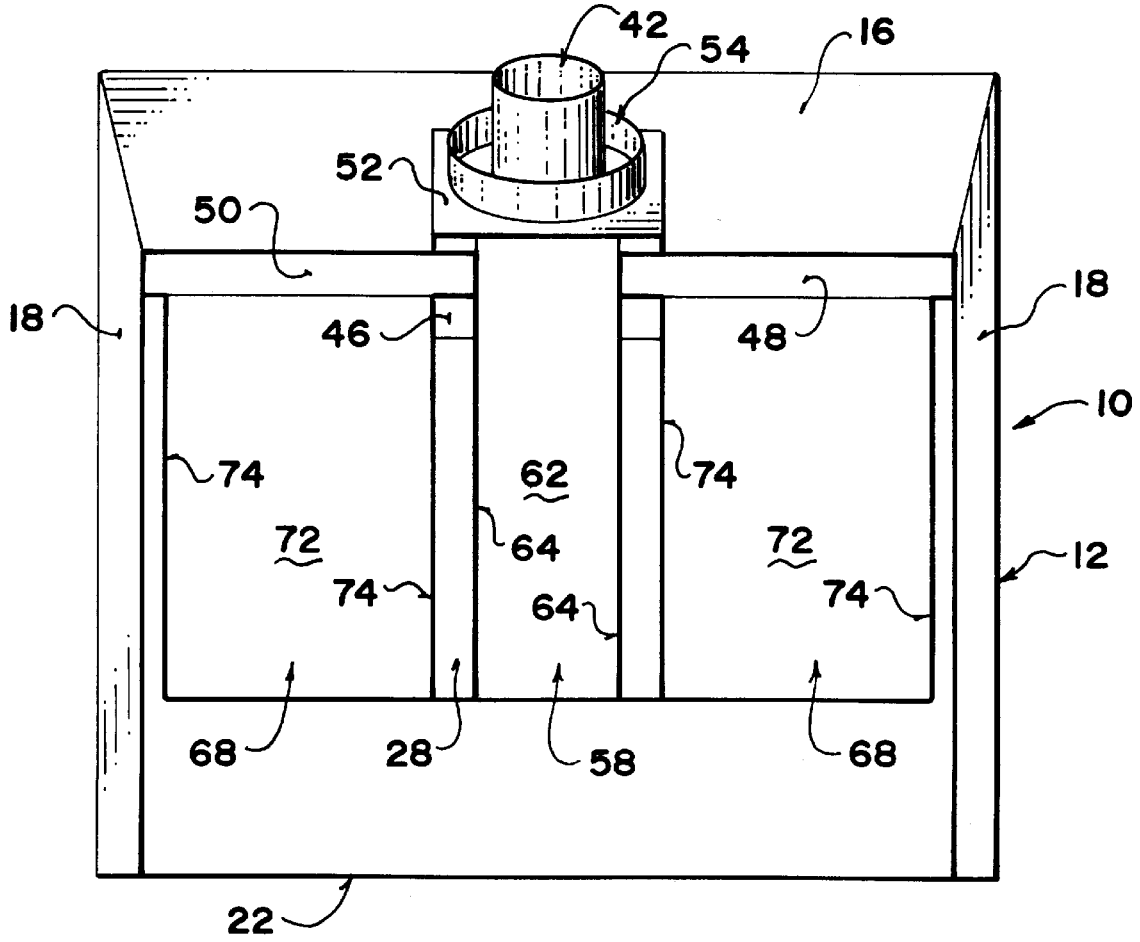
FIG. 4 is a back elevation in cross-section along line 4—4 of FIG. 1.
Figure 3:
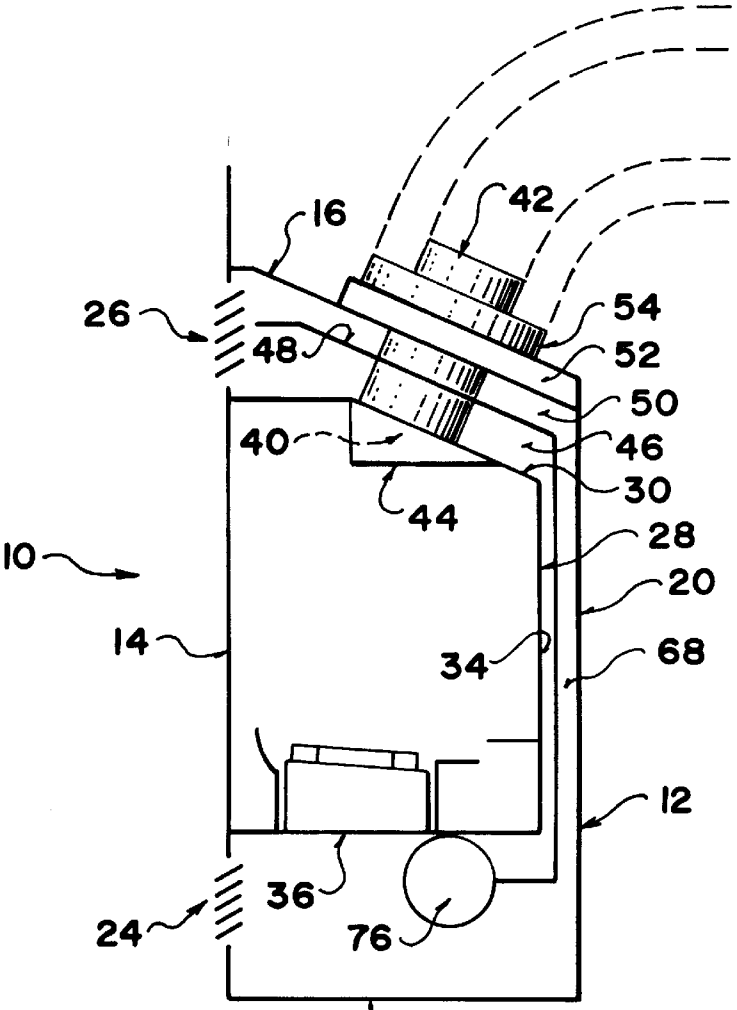
FIG. 3 is a side elevation in cross-section along line 3—3 of FIG. 1.
Figure 2:
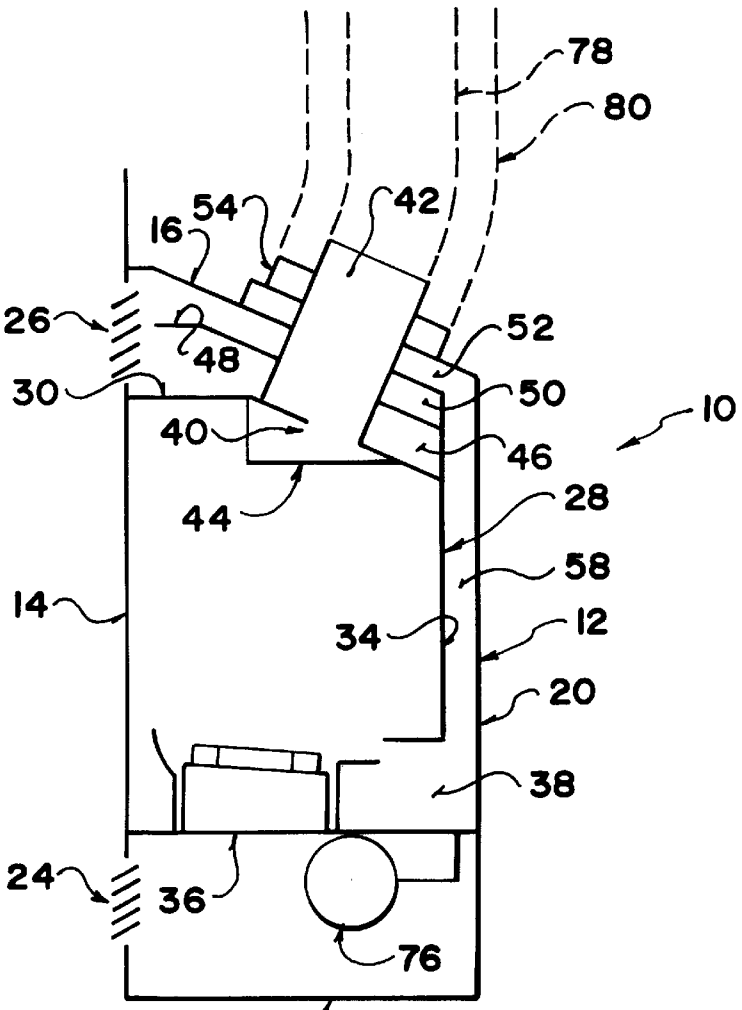
FIG. 2 is a side elevation in cross-section along line 2—2 of FIG. 1.

Referring to the accompanying drawings, there is illustrated a fireplace 10 with an outer sheet metal housing 12 having a glazed front wall 14 through which a fire may be viewed. The housing has a top wall 16 that slopes downwardly to the back. The housing also has two rearwardly convergent side walls 18, a back wall 20 and a bottom wall 22. In the front of the housing, below the glass front is a room air inlet 24. Above the glass in the front wall is a warm air discharge 26.

Inset into the housing 12 above the air inlet 24 and below the air discharge 26 is a sheet metal firebox 28. This includes a top wall 30 with a back part that slopes down to the rear, parallel to the top wall 16. Two parallel side walls 32, a back wall 34 and a bottom wall 36 are all spaced inwardly from the corresponding walls of the housing 12. At the bottom of the back wall 34 is a combustion air inlet 38.

In the top wall 30 of the firebox is an exhaust gas outlet 40. This is connected to an exhaust duct 42. Extending across the outlet 40 is a baffle 44 for controlling the flow of exhaust gases through the exhaust duct.

The exhaust duct passes through a room air plenum 46 between the firebox top wall 30 and a plate 48 parallel to the top wall 16 of the housing. The exhaust duct also passes through a cooling air plenum 50 between the plate 48 and the top wall 16 of the housing and through a combustion air plenum 52 on top of the housing top wall 16. The top of the combustion air plenum 52 carries an annular fitting 54 for connection to a combustion air vent pipe 56 for drawing in fresh outside air for combustion.

Between the back walls 20 and 34 is a combustion air duct 58, leading to the combustion air inlet 38 from the combustion air plenum 52. This is a sheet metal channel 60 with a web 62 in contact with the inner back wall 34 and two flanges 64 that project from the web into engagement with the outer back wall 20. The flanges are fastened to the outer back wall 20.

On opposite sides of the combustion air duct are cooling air ducts 68. These are sheet metal channels 70 with webs 72 between the back walls 20 and 34 and edge flanges 74 that project into engagement with the outer back wall 20 where they are fastened in place. The webs 72 are connected to the back edge of the plate 48 so that air passing through the ducts 68 will pass through the cooling air plenum 50 to the air discharge 26 at the front of the housing.

The cooling air ducts are arranged to draw air from the areas near the bottom wall 22 of the housing 12. This is the coolest area within the housing so that the coolest possible air can be passed through the cooling air ducts to minimize the temperature of the outer back wall and the top wall 16.

A blower 76 between the bottom walls blows room air through ducts 68 and the space between ducts 68 and the firebox back wall 34. The latter flow passes through the room air plenum 46 to the warm air discharge 26. This air flow picks up heat from the firebox as it passes through the housing.

The top walls 16 and 30 are inclined to the horizontal at an angle less than 45°. The preferred angles are less than 30° with the preferred embodiment being oriented at an angle of 23.2° to the horizontal. This orients the exhaust duct and combustion air fitting at an angle greater than 45° to horizontal, preferably greater than 60°, and 66.8° for the preferred embodiment. This arrangement is used with a flexible exhaust pipe 78 and a flexible combustion air pipe 80 to accommodate the bend to a vertical orientation without projecting beyond the back side of the fireplace. This means that the flue and vent connections do not limit the installation options. Because the top walls are sloped, the flexible tubes may also be bent into a horizontal orientation for back vent installations.

While one embodiment of the present invention has been described in the foregoing, it is to be understood that other embodiments are possible within the scope of the invention and are intended to be included herein. The invention is to be considered limited solely by the scope of the appended claims.

I claim:

1. A fireplace comprising:

an outer sheet metal housing having:

a bottom, a vertical outer back wall, upright side walls, and a sloped outer top wall sloping upwardly from the outer back wall towards a front side of the outer housing;

an inner sheet metal fire box inside the outer housing with an air space around the firebox and inside the housing, the firebox having:

a vertical inner back wall spaced from the outer back wall of the outer housing, the vertical inner back wall having a combustion air inlet therethrough, adjacent a bottom end of the inner back wall, a sloped inner top wall sloping upwardly from the inner back wall toward a front side of the fire box and spaced from the outer top wall, an inner bottom wall spaced from the bottom of the housing;

a combustion air duct comprising a combustion air plenum on top of the outer top wall and a duct between the outer and inner back walls, the duct extending from the plenum to the combustion air inlet;

two cooling air ducts extending along the outer back wall on opposite sides of the combustion air duct and spaced from the inner back wall such that said air space extends between the cooling air ducts and the firebox, the cooling air ducts having respective cooling air inlets, the cooling air inlets being positioned between the bottom of the outer housing and the inner bottom wall, and adjacent the respective side walls;

a cooling air plenum between the inner and outer top walls, extending from the cooling air ducts to a warm air discharge;

an exhaust gas outlet extending outwardly from an opening in the inner top wall through the cooling air and combustion air plenums; and a fresh air inlet concentric with the exhaust gas outlet and communicating with the combustion air plenum.

2. A fireplace according to claim 1 wherein the combustion air duct comprises a sheet metal channel with a web spaced from the outer back wall and two flanges projecting from the web, the flanges being secured to the outer back wall.

3. A fireplace according to claim 2 wherein the web is in contact with the inner back wall.

4. A fireplace according to claim 1 wherein said air space comprises a room air plenum between the cooling air plenum and the inner top wall, extending along the top of the firebox to the warm air discharge.

5. A fireplace according to claim 4 including a blower for blowing air through the part of said air space between the cooling air ducts and the inner back wall and through the room air plenum.

6. A fireplace according to claim 1 wherein the outer top wall and the inner top wall slope at an angle between 0° and 45° To horizontal.

7. A fireplace according to claim 6 wherein the outer top wall and the inner top wall are sloped at an angle between 0° and 30° to horizontal.

8. A fireplace according to claim 6 wherein the outer top wall and the inner top wall are sloped at an angle of substantially 23.2° to horizontal.

* * * * *